US005862527A

United States Patent [19]

Trevino

[11] Patent Number: 5,862,527

[45] Date of Patent: Jan. 26, 1999

[54] DISPOSABLE SURGICAL UNDERGARMENT

[76] Inventor: Hilario Trevino, 343 W. Houston, Suite 511, San Antonio, Tex. 78205

[21] Appl. No.: 732,931

[22] Filed: Oct. 17, 1996

[51] Int. Cl.[6] ..... A41B 9/04; A41C 3/00

[52] U.S. Cl. ..... 2/406; 2/408; 450/67

[58] Field of Search ..... 2/406, 400, 407, 2/408; 450/67–69, 81, 86

[56] References Cited

U.S. PATENT DOCUMENTS

| | | | |
|---|---|---|---|
| 3,229,875 | 1/1966 | Stoller | 2/239 |
| 3,780,380 | 12/1973 | Lafollette . | |
| 4,031,900 | 6/1977 | Guidoni | 450/69 |
| 4,205,679 | 6/1980 | Repke et al. | 2/406 |
| 5,440,764 | 8/1995 | Matsushita | 2/406 |
| 5,461,724 | 10/1995 | Wiedner et al. . | |
| 5,546,607 | 8/1996 | Roberts | 2/406 |
| 5,546,608 | 8/1996 | Russano | 2/406 |

FOREIGN PATENT DOCUMENTS

| | | | |
|---|---|---|---|
| 2170394 | 8/1986 | United Kingdom | 2/406 |

*Primary Examiner*—Gloria M. Hale
*Attorney, Agent, or Firm*—Jenkens & Gilchrist

[57] ABSTRACT

An undergarment designed to be worn by patients undergoing surgery or wearing a hospital gown. The undergarment consists of a unisex brief and an optional brassiere for women. The undergarment is made from a waterproof material and is disposable. The loose fit of the undergarment is aided through the use of elastic. The purpose of the undergarment is to help patients feel more comfortable when wearing a surgical gown, thereby decreasing their apprehension associated with a hospital visit.

6 Claims, 2 Drawing Sheets

DISPOSABLE SURGICAL UNDERGARMENT

BACKGROUND OF THE INVENTION

1. Field of the Invention

The present invention relates to a unique undergarment designed to be worn by a patient during surgery. In particular, the undergarment provides patients undergoing surgery with peace of mind that their private parts will not be unnecessarily exposed during an operation or otherwise during their medical treatment.

2. Description of the Related Art

An almost universal rule followed by the majority of, if not all, hospitals today is that any patient going to the operating room for surgery must go clothed in at most a surgical gown. In particular, patients are not allowed to wear undergarments when going to surgery. This rule arose in the infancy of modern medicine based on two reasons. First, when modern medicine was first getting started, people were not able to nor did they care to keep themselves as clean as they do today. Thus, undergarments were not allowed in surgery for hygienic reasons in that the patient's undergarments were often soiled. The second reason for the universal rule was that undergarments during this time were predominantly made from nylon which was susceptible to sparking when passed over another piece of nylon. The anesthesia used during this time was highly explosive, making any source of spark or flame strictly forbidden in the operating room.

Although these two reasons are no longer valid today, the practice of having the patient remove all undergarments and wear at most a surgical gown when going into surgery still persists. In fact, patients are often clothed in only a hospital gown when staying in a hospital, whether surgery will be performed or not. The surgical gowns of today are made of very thin material and are completely slit open in the back with only a single tie located approximately at waist height provided to hold the back of the gown closed. The gown is uncomfortable for most patients to wear because the tie may come undone without the patient being aware of it. In addition, even when the tie is secure, the design of the surgical gown is such that the back of the gown cannot provide adequate coverage of the patient's back and buttocks. Further, once in surgery, the tie is undone and the gown is typically pushed aside for the surgery, thereby completely exposing the unconscious patient.

Surgery can be at worst terrifying and at its best strange and uncomfortable. Often, the outcome of the surgery is unpredictable. This, coupled with the fact that the patient will be anesthetized throughout the process, can make surgery a frightening experience. Thus, anything which can help ease the patient's concerns about the surgery itself is quite helpful. One area in which patients experience a high degree of discomfort is when they are asked to wear only the surgical gown without any undergarments into the surgery. Patients know that they will be unconscious and thus will lose control over the exposure of their body, in particular, their private parts.

It is, therefore, an object of this invention to provide an inexpensive, disposable undergarment for patients undergoing surgery or spending time in a hospital in general.

It is another object of this invention to provide versions of the undergarment which can be worn by both men and women.

It is still another object of this invention to provide a surgical undergarment which increases the hygienic aspects of surgery.

It is still another object of this invention to protect the perineum and other sensitive skin from the iodine preparation used in surgery especially when surgery will be performed on the lower extremities.

It is yet another object of this invention to contain the spread of contamination by a surgical patient's accidental urination or expression of feces while in the operating room.

It is yet another object of this invention to provide an undergarment to cover patients staying in the hospital.

To achieve these and other objects which will become readily apparent upon a reading of the attached disclosure and appended claims, a disposable undergarment is provided. Additional objects, advantages, and novel features of the invention will be set forth in part in the description which follows, and in part will become apparent to those skilled in the art upon examination of the following, or may be learned by practice of the invention. The objects and advantages of the invention may be realized and attained by means of the instrumentalities and combinations particularly pointed out in the appended claims.

SUMMARY OF THE INVENTION

According to the present invention, the foregoing and other objects and advantages are attained by a disposable undergarment designed to be worn by a patient undergoing surgery as well as in other hospital settings. The undergarment generally comprises a two or three size, unisex brief which covers the genitalia and buttocks, and a simple, one-size-fits-all brassiere for females. The material from which the undergarments are made is cloth-like and waterproof. The brief has three openings, each of which is lined with elastic for a proper, yet variable fit. Similarly, the top and bottom edges of the brassiere are lined with elastic. At each end of the brassiere is a circular piece of elastic through which the patient's arms are placed while wearing the brassiere. Further, a single piece of elastic is attached to one of the circular pieces of elastic at one end and attached to the other circular piece of elastic at its other end. This last piece of elastic serves as a strap which is placed around the patient's back when wearing the brassiere. The undergarment is designed to be worn under the standard hospital gown both while in surgery and when staying in the hospital in general. Thus, patients clothed in the undergarment of the present invention are able to maintain control over unnecessary exposure of their body while in the hospital and especially during surgery.

Still other objects and advantages of the present invention will become readily apparent to those skilled in this art from the following detailed description, wherein multiple preferred embodiments of the invention are shown and described, simply by way of illustration of the best mode contemplated by the inventor for carrying out the invention. As will be realized, the invention is capable of other and different embodiments, and its several details are capable of modifications in various obvious respects, all without departing from the invention. Accordingly, the drawings and description are to be regarded as illustrative in nature, and not as restrictive.

DESCRIPTION OF THE PREFERRED EMBODIMENT

As generally described above, the undergarment of the present invention has practical application in a number of situations. The undergarment is designed to be worn by a patient undergoing surgery in order to protect the patient's privacy by providing a covering for the patient's private parts. Applications for the surgical undergarments include x-ray examination; surgery on the upper or lower extremities, thorax, open heart, upper abdomen, head, neck, and upper spine; as well as limited use during gynecological and urological surgery, especially during associated post-partum care.

The undergarment is designed to be worn underneath a standard hospital gown which is completely open in the back, except for a single tie located approximately at waist height. Most patients going into surgery that are permitted to wear the undergarment of the present invention are made to feel more comfortable in knowing that during transportation to and from surgery and, more importantly, during surgery (while they are anesthetized) their private body parts will remain covered by the undergarment. The ability of the undergarment to decrease a patient's apprehension before surgery in this regard is clearly of great benefit both to the patient and to the treating medical personnel. Further, the undergarment can be worn by the patient when required to wear the standard hospital gown during any length of stay in the hospital.

Figure 1:
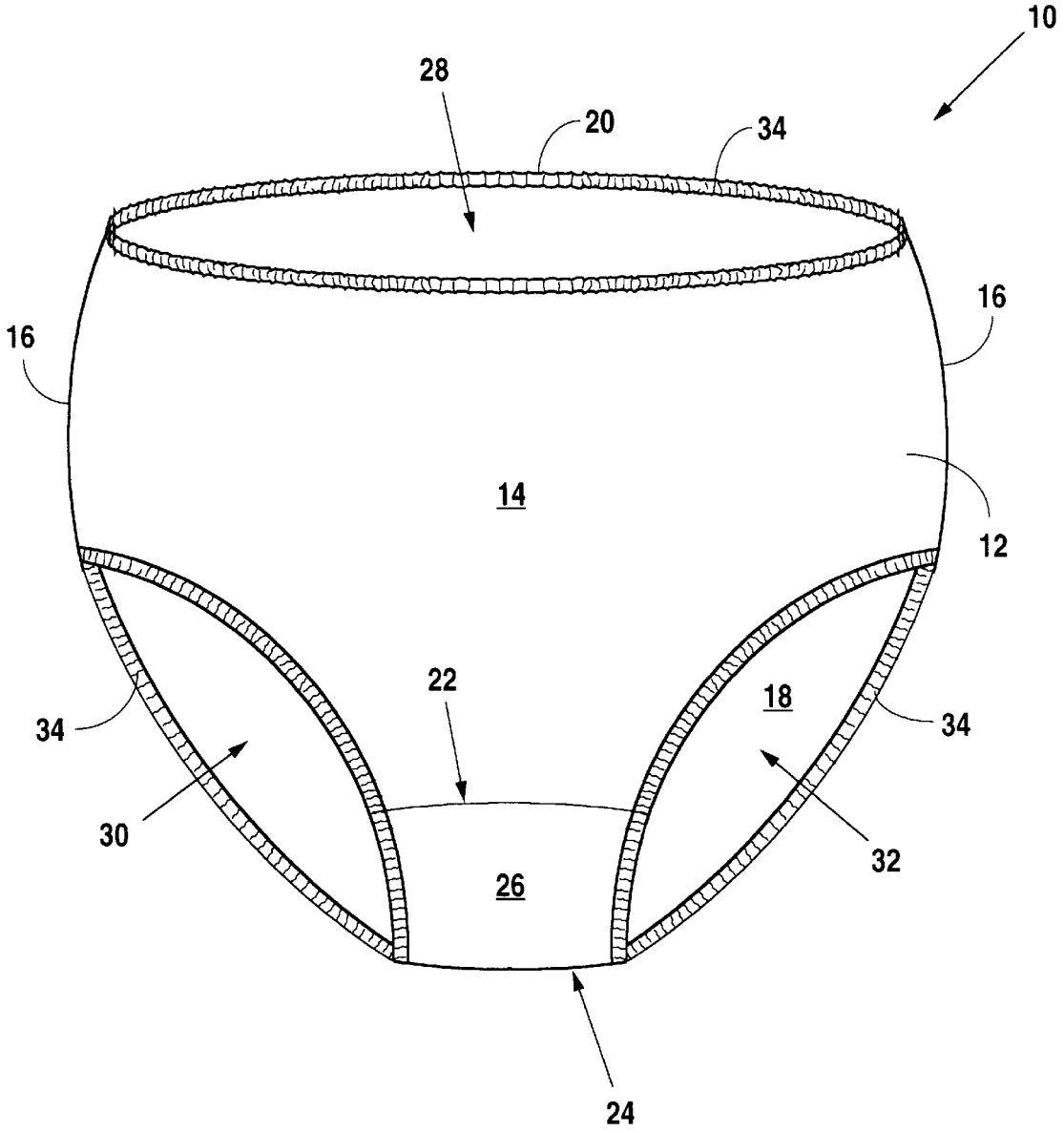
FIG. 1 is a front view of a preferred embodiment of the brief version of the undergarment of the present invention.
Figure 2:
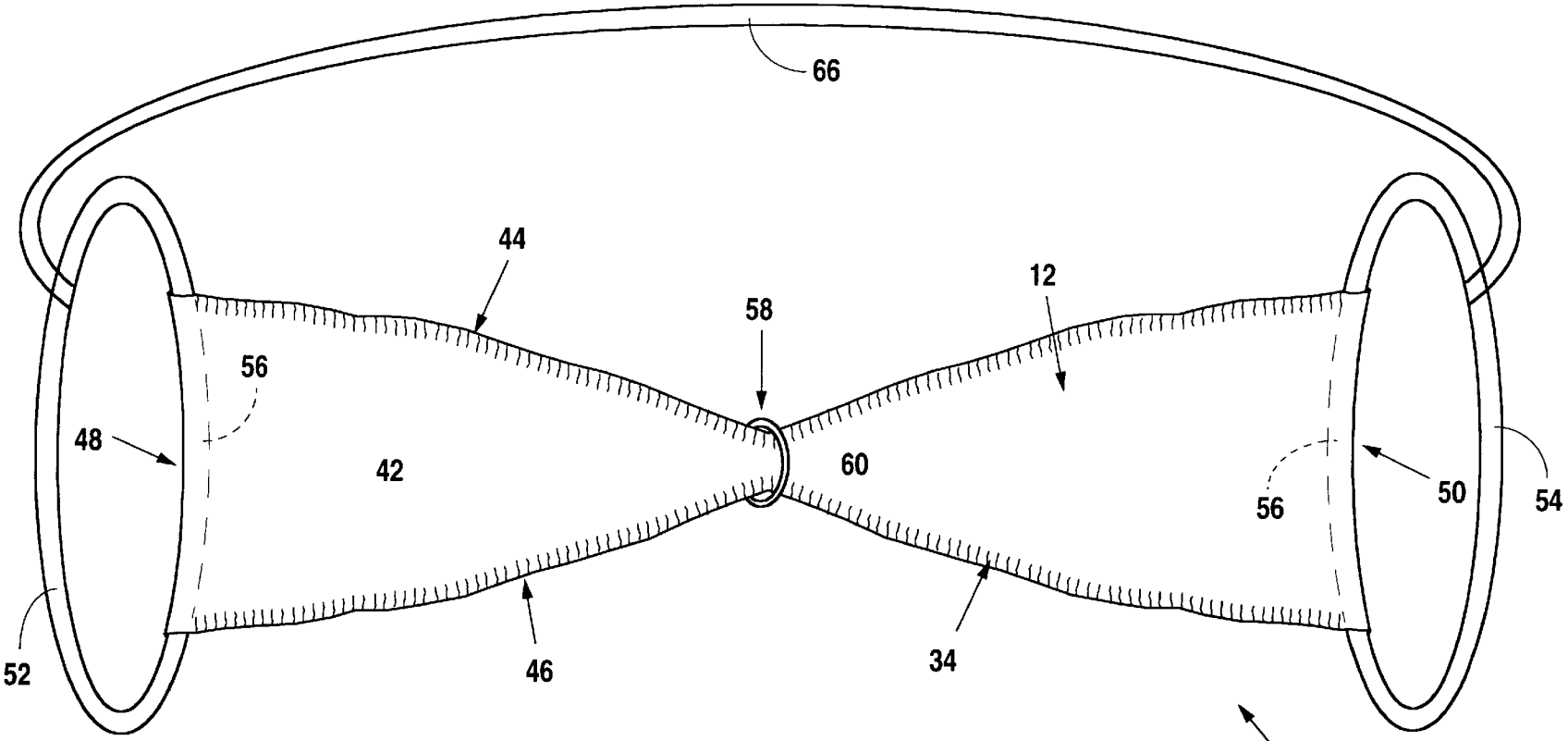
FIG. 2 is a front view of the brassiere version of the undergarment of the present invention.

Reference is made, therefore, to FIG. 1 for a description of the preferred embodiment of the current invention. FIG. 1 shows the undergarment brief (10) which is worn by the patient to cover the genitalia and buttocks. In the preferred embodiment, the brief (10) is made from a cloth-like material (12) which is breathable but will not allow fluids to pass through. The material (12) is lightweight and comfortable. The brief (10) is composed of three panels which are sewn together. The front panel (14) has a general T-shape. Sewn to the front panel (14) along the two upper "T" edges (16) is rear panel (18). Rear panel (18) is approximately circular in shape with a generally flat upper edge (20). Connecting the lower "T" edge (22) of front panel (14) and the lower edge (24) of rear panel (18) is lower panel (26). Lower panel (26) has a generally rectangular shape. Typically, the panels (14, 18, 26) are joined together through sewing so as to form a seam along their connecting points. Furthermore, front panel (14), rear panel (18) and lower panel (26) are interconnected so as to form a waist opening (28) and two leg openings (30, 32). Each opening (28, 30, 32) is lined with elastic (34) around its circumference so that the opening is variable in size. The elasticity forces present in the elastic (34) are such that they do not unnecessarily constrict blood flow in the patient, but are strong enough to largely, if not entirely, prevent leakage of any fluid out of the brief (10). Besides allowing the brief (10) to be worn by a wide range of differently-sized patients, the elastic (34) in combination with the waterproof material (12) helps to reduce contamination of the sterile operating room due to a patient's accidental urination or expression of feces. Use of the brief (10) further protects any tourniquet applied to a patient having surgery on a lower extremity from contact with the patient's perineum and subsequent contamination of the tourniquet. Use of the brief (10) also protects the patient's sensitive skin found near the perineum and genitalia from irritation due to contact with the iodine preparation used in surgery.

So that female patients may keep their upper bodies covered during surgery, the present invention also provides a brassiere (40). The brassiere (40) is composed of a generally rectangular body (42) which is made from the same material (12) as used for the brief (10). The body has a top border (44), a bottom border (46), and two side borders (48, 50). Both the top border (44) and the bottom border (46) are lined with elastic (34). Along each side border (48, 50), a strap (52, 54) is attached. In the preferred embodiment, the strap (52, 54) is made from elastic and is passed through a narrow channel (56) formed along each side border (48, 50). Once the strap (52, 54) is passed through the channel (56), its two ends are connected together to form a loop. The patient places each arm through one of the straps (52, 54) respectively, such that the body (42) covers the patient's breasts. The body (42) of the brassiere (40) is gathered together at its midpoint (58) through any of a number of means. In the preferred embodiment, the gathering is accomplished through the use of a ring (60) which divides the body (42) into two cups (62, 64). The brassiere (40) further includes an additional backstrap (66) which is attached to each strap (52, 54). The backstrap (66) is designed to run across the patient's back, thereby providing additional securing support for the brassiere (40). The backstrap (66) may be permanently attached to a particular point on each strap (52, 54), such as by sewing. Alternatively, backstrap (66) may contain small loops at each end, which loops encircle straps (52, 54) and permit adjustment of the backstrap (66) relative to the straps (52, 54).

In the preferred embodiment, the brief (10) and brassiere (40) are made in three sizes designed to fit a wide variety of body shapes. Both the brief (10) and brassiere (40) are designed to fit loosely and therefore to be more comfortable to the patient. Large, medium, and small brief sizes accommodate the average-sized patient as well as large patients and children.

Various alterations in the invention as disclosed may be made without departing from this disclosure. For example, a wide variety of material (12) from which the brief (10) and brassiere (40) are made may be used for different applications. Further, the brief (10) may not have lower panel (26), but instead be composed from front panel (14) and rear panel (18). Along these same lines, the brief (10) may be cut from a single piece of material and sewn in such a way as to form the requisite shape and openings (28, 30, 32).

It is intended that the above description of the preferred embodiment of the structure of the present invention is but one enabling best mode embodiment for implementing the invention. Variations in the above description likely to be conceived of by those skilled in the art still fall within the breadth and scope of the disclosure of the present invention.

The primary import of the present invention lies in its ability to decrease a patient's discomfort when wearing a hospital gown either for surgery or when staying in the hospital. Its benefits derive from its simple solution to a prevalent problem and its extremely low cost. Again, it is understood that other applications of the present invention will be apparent to those skilled in the art upon a reading of the preferred embodiments and consideration of the appended claims and drawings.

I claim:

1. An undergarment for patient, said undergarment comprising:

a disposable, loose-fitting brief made from a waterproof material, said brief having a waist opening and two leg openings; and a loose-fitting brassiere made from a waterproof material; said brassiere further comprises:

a body having a general rectangular shape with a midpoint, a top border, a bottom border, and two side borders;

two straps each of which is connected to one of said two side borders so as to form a loop;

a ring located approximately at said midpoint of said body; and a backstrap connected at one end to one of said straps and at the other end to the other of said straps wherein said undergarment is designed to be worn under a hospital gown to provide added privacy to said patient.

2. The undergarment of claim 1, wherein said connections are made through sewing.

3. An undergarment designed for a patient wearing a hospital gown, said undergarment consisting of:

a disposable, loose-fitting brief made from a single layer of non-absorbent, waterproof material, said brief having a waist opening and two leg openings; and a disposable, loose-fitting brassiere made from a single layer of non-absorbent, waterproof material; said brassiere comprises:

a body having a general rectangular shape with a midpoint, a top border, a bottom border, and two side borders;

two straps each of which is connected to one of said two side borders so as to form a loop;

a ring located approximately at said midpoint of said body; and a backstrap connected at one end to one of said straps and at the other end to the other of said straps wherein said undergarment is worn under said hospital gown to provide added privacy to said patient.

4. An undergarment designed for a patient wearing a hospital gown, said undergarment comprising:

a disposable, loose-fitting brief made from waterproof material, said brief having a waist opening and two leg openings; and a disposable, loose-fitting brassiere made from waterproof material, wherein said brassiere further comprises a body having a general rectangular shape with a midpoint, a top border, a bottom border, and two side borders; two straps, each of which is connected to one of said two side borders so as to form a loop; a ring located approximately at said midpoint of said body; and a backstrap connected at one end to one of said straps and at the other end to the other of said straps, wherein said undergarment is worn under said hospital gown to provide added privacy to said patient.

5. The undergarment of claim 4, wherein said connections are made through sewing.

6. An undergarment designed for a patient wearing a hospital gown, said undergarment consisting of:

a disposable, loose-fitting brief made from a single layer of non-absorbent, waterproof material, said brief having a waist opening and two leg openings; and a disposable, loose-fitting brassiere made from a single layer of non-absorbent, waterproof material, wherein said brassiere comprises a body having a general rectangular shape with a midpoint, a top border, a bottom border, and two side borders; two straps, each of which is connected to one of said two side borders so as to form a loop; a ring located approximately at said midpoint of said body; and a backstrap connected at one end to one of said straps ad at the other end to the other of said straps, wherein said undergarment is worn under said hospital gown to provide added privacy to said patient.

* * * * *